United States Patent [19]

Tippins et al.

[11] 4,433,566

[45] Feb. 28, 1984

[54] CLOSE COUPLED REVERSING ROUGHER AND FINISHING TRAIN AND METHOD OF ROLLING

[75] Inventors: George W. Tippins; Vladimir B. Ginzburg, both of Pittsburgh, Pa.

[73] Assignee: Tippins Machinery Company, Inc., Pittsburgh, Pa.

[21] Appl. No.: 306,892

[22] Filed: Sep. 29, 1981

[51] Int. Cl.[3] ..... B21B 1/32; B21B 1/02

[52] U.S. Cl. ..... 72/229; 72/234; 72/366

[58] Field of Search ..... 72/226, 227, 229, 231, 72/234, 366

[56] References Cited

U.S. PATENT DOCUMENTS 3,803,891 4/1974 Smith ..... 72/231

4,308,739 1/1982 Tippins ..... 72/229

*Primary Examiner*—Lowell A. Larson

*Assistant Examiner*—Steven B. Katz

*Attorney, Agent, or Firm*—Webb, Burden, Robinson & Webb

[57] ABSTRACT

A hot strip mill includes at least one roughing reversing mill and a finishing train with the reversing mill spaced from the finishing mill by a distance greater than the length of the transfer bar on the penultimate pass but less than the distance of the final pass through the roughing reversing mill so as to be close coupled to the finishing train on that last pass. The method of rolling includes close coupling the reversing roughing mill to the finishing mill on the last downstream pass through the reversing roughing mill.

3 Claims, 4 Drawing Figures

CLOSE COUPLED REVERSING ROUGHER AND FINISHING TRAIN AND METHOD OF ROLLING

FIELD OF THE INVENTION

Our invention relates to hot strip mills and, more particularly, to hot strip mills for reducing slabs to strip thicknesses on the order of 500 to 1000 PIW.

DESCRIPTION OF THE PRIOR ART

Heretofore, hot strip mills have consisted of a roughing train and a finishing train separated by a holding table to accommodate the transfer bar out of the roughing train and direct that transfer bar into the finishing train at the desired suck-in speed. As longer slabs are available through continuous slab casting and as the demand for larger coils increases, the length of the holding table to accommodate free transfer bars has greatly increased. Longer hot mills add to the existing problem of heat loss through radiation and increased temperature differentials from head to tail of a transfer bar and ultimate coil.

A number of solutions have been employed to minimize heat loss through radiation and decrease the head-tail temperature differential. For example, coil boxes have been provided to hold the transfer bar in coil form prior to introduction into the finishing train. Tunnel furnaces have also been employed over the holding table so that the transfer bar is maintained at the appropriate temperature. Another attempt to solve this problem has been through the utilization of an intermediate mill having coiling furnaces on either side of a reversing mill. While all of these solutions have been successful in varying degrees, there still remains a need for a mill which can handle the longer slabs and greater PIW coils without excesive auxiliary equipment and maintain acceptable temperature differentials.

The construction costs of a new hot strip mill have been estimated at $60,000.00/foot so the solution of longer mills to accommodate bigger PIW coils not only present temperature problems but it is not always economically feasible as well. All of the existing mills and all of the new mills must provide a temperature differential between the head and tail of the workpiece which will provide the necessary uniformity of the product in terms of its metallurgical properties and which will not cause undue loading conditions on the various mill stands.

SUMMARY OF THE INVENTION

Our invention eliminates the transfer bar as it is presently known. Our invention further avoids the auxiliary equipment such as coil boxes, intermediate mills and tunnel furnaces as employed heretofore. In addition, our invention results in a much shorter hot strip mill as compared to existing mills. All of this is accomplished in a way that permits the temperature of the slabs out of the reheat furnace to be drastically reduced in comparison with existing practice. This reduction in slab temperature out of the reheat furnace translates into tremendous energy savings which translate into reduced operating costs. All of this is accomplished while still maintaining reasonable temperature differentials so as to provide uniform metallurgical properties without unduly loading the various mill stands.

Our invention provides for the close coupling of the roughing train to the finishing train on the last pass through the roughing mill. This, therefore, eliminates the need for the long holding table which heretofore has accommodated a free transfer bar. In one embodiment two reversing roughing mills are used in tandem as the roughing train and after two downstream passes and two upstream passes the fifth and sixth pass through the two reversing roughing mills, respectively, are speed matched with the finishing train. In another embodiment a single reversing roughing mill is employed and after a downstream pass and an upstream pass, the third pass through the roughing mill is speed matched with the finishing train. This close coupling permits slabs to be heated to only 1800° or 1850° prior to rolling, whereas in the existing practices slabs are heated to on the order of 2200° prior to rolling.

DESCRIPTION OF THE PREFERRED EMBODIMENTS

Figure 1:
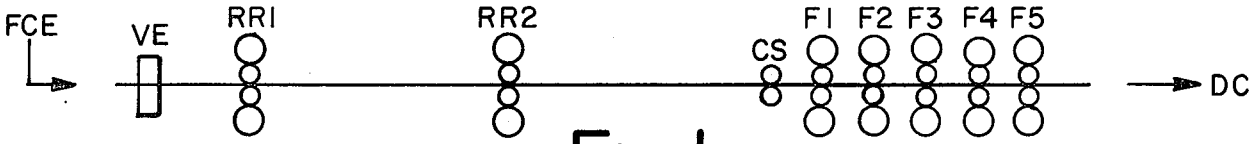
FIG. 1 is a schematic showing the general arrangement of our invention employing two reversing roughers in tandem.

The general arrangement of one form of our invention is illustrated in FIG. 1. The roughing train comprises two reversing roughers RR1 and RR2 which operate in tandem. The reversing roughers RR1 and RR2 are preceded by a vertical edger VE which receives material from a series of reheat furnaces FCE (not shown). Downstream of the reversing rougher RR2 is a crop shear and a finishing train comprised of finishing stands F1 through F5. Exiting the finishing stands the strip proceeds down a runout table where it is cooled by water sprays prior to being coiled on a downcoiler DC or otherwise disposed of such as cut into hot mill sheets.

The reversing roughers RR1 and RR2 are generally separated by a distance on the order of 30 feet. The distance from the downstream reversing rougher RR2 to the first finishing stand F1 is on the order of 70 feet and the finishing train includes a plurality of mill stands F1 through F5 which are spaced at 18 foot intervals. This distance of approximately 190 feet compares with existing mills in which the distance between the first roughing stand and the final finishing stand is often on the order of 600 feet or greater.

Figure 3:
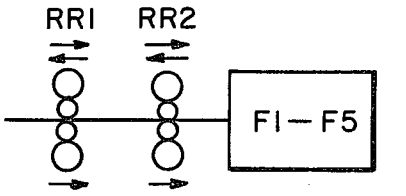
FIG. 3 is a schematic showing the sequence of passes through the general arrangement of FIG. 1.

The pass sequence through the arrangement of FIG. 1 is illustrated in FIG. 3. In conjunction with the pass sequence the following Table 1 gives the temperature and thickness profile for our hot strip mill including the double reversing roughers RR1 and RR2.

TABLE 1

Temperature and Thickness Profile*
Double Reversing Rougher

| Mill | Gauge Inches | Speed FPM Front | Speed FPM Tail | Exit Temperature °F. Front | Exit Temperature °F. Tail |
|---|---|---|---|---|---|
| Furnace | 9 | — | — | 1850 | 1850 |
| RR1 | 7.25 | 91 | 125 | 1831 | 1828 |
| RR2 | 5.5 | 165 | 165 | 1822 | 1830 |
| RR2 | 4.25 | 611 | 611 | 1826 | 1834 |

TABLE 1-continued

Temperature and Thickness Profile*
Double Reversing Rougher

| Mill | Gauge Inches | Speed FPM Front | Speed FPM Tail | Exit Temperature °F. Front | Exit Temperature °F. Tail |
|---|---|---|---|---|---|
| RR1 | 3.25 | 800 | 800 | 1828 | 1786 |
| RR1 | 2.25 | 600 | 98 | 1831 | 1762 |
| RR2 | 1.25 | 600 | 177 | 1829 | 1716 |
| F1 | .625 | 306 | 355 | 1806 | 1715 |
| F2 | .337 | 568 | 658 | 1794 | 1713 |
| F3 | .206 | 930 | 1077 | 1780 | 1708 |
| F4 | .138 | 1388 | 1608 | 1764 | 1701 |
| F5 | .111 | 1726 | 2000 | 1742 | 1687 |

*Designation front (head) and tail refer to position of slab out of furnace.

The above rolling schedule is for 1000 PIW coils rolled from a nine inch slab by 39½ inches wide by 32.7 feet long and exiting a slab reheat furnace at 1850°. The initial two passes through RR1 and RR2 are close coupled and in the forward or downstream direction. The transfer bar out of RR2 after the two passes is free in that its length is such that it has not as yet entered the finishing train. The free transfer bar is then reduced in a third and fourth pass in the upstream direction through RR2 and RR1, respectively. The speed on the first four passes is totally independent of the finishing train and, therefore, is governed by other limiting factors such as mill loads and scheduled cycle times, etc. The fifth and sixth pass of the transfer bar through RR1 and RR2, respectively, are in the forward or downstream direction and are generally carried out at a speed appreciably less than the speed of the second and third pass.

Since RR1 and RR2 are close coupled to the finishing train, on the fifth and sixth pass the speed of the strip out of RR1 and RR2 must be slowed down so the strip reaches the first finishing stand F1 at the appropriate suck-in speed. The strip then passes through the finishing stands F1 through F5 in conventional manner and conventional zoom practices can be employed to lessen the temperature differential between the head and tail of the coil.

Figure 2:
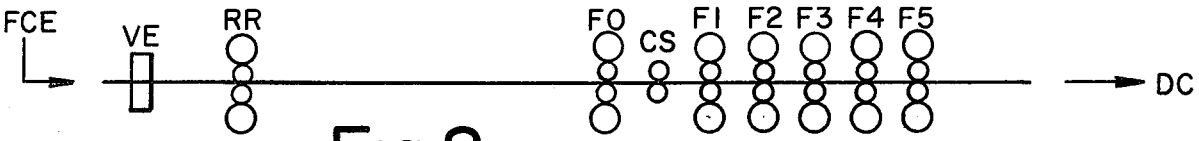
FIG. 2 is a schematic of a general arrangement of our invention showing a single reversing rougher and an F0 finishing stand.
Figure 4:
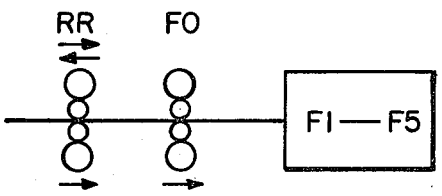
FIG. 4 is a schematic showing the sequence of passes through the general arrangement of FIG. 2.

A modified form of our invention is illustrated in FIGS. 2 and 4. There a single reversing roughing mill RR is preceded by a vertical edger VE. The roughing mill RR is also close coupled to an initial finishing stand F0 which in turn is close coupled into the finishing train comprised of mill stands F1 through F5. The reversing roughing stand RR is spaced from the initial finishing stand F0 by a distance which will accommodate the first downstream pass through the reversing rougher but which is short enough that the second downstream pass through the reversing rougher is close coupled into F0 and the subsequent finishing train.

The temperature and thickness profile for the general arrangement of FIG. 2 and FIG. 4 appears in Table 2. This schedule is also for 1000 PIW coils rolled from slabs 9 inches thick by 39½ inches wide by 32.7 feet long. In this schedule the slab exits the furnace at only 1800° F.

TABLE 2

Temperature and Thickness Profile
Single Reversing Rougher*

| Mill | Gauge Inches | Speed FPM Front | Speed FPM Tail | Temperature °F. Entry Front | Temperature °F. Entry Tail | Temperature °F. Exit Front | Temperature °F. Exit Tail |
|---|---|---|---|---|---|---|---|
| Furnace | 9 | 0 | 0 | 1800 | 1800 | 1800 | 1800 |
| RR1 | 7 | 74 | 74 | 1794 | 1784 | 1783 | 1773 |

TABLE 2-continued

Temperature and Thickness Profile
Single Reversing Rougher*

| Mill | Gauge Inches | Speed FPM Front | Speed FPM Tail | Temperature °F. Entry Front | Temperature °F. Entry Tail | Temperature °F. Exit Front | Temperature °F. Exit Tail |
|---|---|---|---|---|---|---|---|
| RR2 | 5 | 400 | 400 | 1765 | 1771 | 1771 | 1777 |
| RR3 | 3 | 74 | 77 | 1768 | 1736 | 1741 | 1712 |
| F0 | 1.25 | 168 | 186 | 1703 | 1675 | 1685 | 1662 |
| F1 | .625 | 337 | 373 | 1665 | 1644 | 1647 | 1631 |
| F2 | .337 | 625 | 691 | 1635 | 1621 | 1648 | 1635 |
| F3 | .206 | 1023 | 1131 | 1636 | 1624 | 1646 | 1637 |
| F4 | .138 | 1528 | 1689 | 1634 | 1626 | 1642 | 1636 |
| F5 | .111 | 1900 | 2100 | 1630 | 1625 | 1632 | 1628 |

*Designation front (head) and tail refers to position out of furnace.

It can be seen that the second pass, identified as RR2, which is in the upstream direction, can be carried out at speeds several times in excess of the third pass RR3 through the reversing rougher, which third pass is speed matched with F0 and the subsequent finishing train F1 through F5. It should be noted that the zoom accorded to the last portion of the strip through the finishing mills is sufficient so as to greatly reduce any temperature differential between the front and tail of the coil. The particular length of the mill is 60 feet from RR to F0, 30 feet from F0 to F1 and a finishing train of F1 through F5 spaced at 18 feet intervals. This total also compares favorably with the existing mills which are often twice or more as long between the first roughing stand and the last finishing stand.

Thus, it can be seen that by close coupling the final passes in the roughing train with the finishing train we are able to eliminate the holding table and transfer bar as previously known and greatly reduce the length of the mill. We also substantially reduce the temperature of the slab coming out of the furnace thereby saving considerable energy costs. In addition, we have eliminated the need for coil boxes, intermediate mills or tunnel furnaces and other auxiliary equipment that have been used heretofore.

We claim:

1. A method of rolling slabs to strip thicknesses on the order of 500–1000 PIW on a hot strip mill including at least one roughing reversing mill for forming a transfer bar, an F0 mill stand and a finishing train having a plurality of mill stands for reducing the transfer bar to strip comprising:

A. spacing said reversing mill from the F0 mill stand by a distance greater than the length of the transfer bar on the downstream pass immediately prior to the penultimate pass through said at least one rougher but less than the distance of the final pass through said at least one rougher;

B. reducing said slab to a free transfer bar on a reversing rough in a first pass directed downstream;

C. further reducing said free transfer bar through said reversing rougher in a second pass directed upstream; and D. passing said transfer bar directly and uninterruptedly from said reversing rougher through said reversing mill in a third reducing pass reducing said transfer bar to a thickness of on the order of 3 inches and in a downstream direction while speed matching it in close coupled relationship to said F0 stand and said finishing train, without coiling said bar.

2. The method of claim 1 including rolling the second pass at a speed substantially greater than the third pass.

3. A method of rolling slabs to strip thicknesses on the order of 500 to 1000 PIW on a hot strip mill including a pair of close coupled reversing mills for forming a transfer bar and a finishing train having a plurality of mill stands for reducing the transfer bar to a strip comprising:

A. spacing a downstream reversing mill from a first mill stand in the finishing train by a distance greater than the length of the transfer bar on the downstream pass immediately prior to the penultimate pass through said downstream reversing mill but less than the distance of the final pass through said downstream reversing mill;

B. reducing said slab in a first and second pass through the close coupled reversing mills, respectively in a downstream direction to form a free transfer bar;

C. further reducing said free transfer bar in a third and fourth pass through said reversing mills, respectively in an upstream direction, said reducing being on the order of 3 inches on the fourth pass; and D. passing said transfer bar directly and uninterruptedly from said reversing rougher through said reversing mills in a fifth and sixth reducing pass, in a downstream direction without coiling said bar and while speed matching said fifth and sixth pass in close coupled relationship to said finishing train.

* * * * *

UNITED STATES PATENT AND TRADEMARK OFFICE

CERTIFICATE OF CORRECTION

PATENT NO. : 4,433,566

DATED : February 28, 1984

INVENTOR(S) : George W. Tippins et al.

It is certified that error appears in the above-identified patent and that said Letters Patent are hereby corrected as shown below:

Claim 1 - Column 4 Line 56 "rough" should read —rougher—.

Signed and Sealed this

*Twenty-second* Day of *May 1984*

[SEAL]

*Attest:*

GERALD J. MOSSINGHOFF

*Attesting Officer* *Commissioner of Patents and Trademarks*